US006639497B2

(12) United States Patent
Hamadate et al.

(10) Patent No.: US 6,639,497 B2
(45) Date of Patent: Oct. 28, 2003

(54) STATIONARY INDUCTION APPARATUS

(75) Inventors: Yoshio Hamadate, Hitachiohta (JP); Noriyuki Uchiyama, Hitachi (JP); Sadamu Saito, Hitachi (JP); Hiroyuki Fujita, Hitachiohta (JP); Yasunori Ono, Mito (JP); Shouichi Yamamoto, Hitachi (JP); Kenichi Kawamura, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/233,522

(22) Filed: Sep. 4, 2002

(65) Prior Publication Data

US 2002/0196117 A1 Dec. 26, 2002

Related U.S. Application Data

(62) Division of application No. 09/649,595, filed on Aug. 29, 2000, now Pat. No. 6,469,607.

(30) Foreign Application Priority Data

Dec. 3, 1999 (JP) ..... 11-344208

(51) Int. Cl.[7] ..... H01F 27/36
(52) U.S. Cl. ..... 336/84 R; 336/84 M; 336/90
(58) Field of Search ..... 336/84 R, 84 M, 336/60, 84 C, 90, 206

(56) References Cited

U.S. PATENT DOCUMENTS 4,153,891 A * 5/1979 McNutt ..... 336/84 C
4,173,747 A 11/1979 Grimes et al. ..... 336/60
4,176,333 A * 11/1979 Bennon et al. ..... 336/60
4,231,074 A 10/1980 McNutt et al. ..... 336/84 C
4,492,314 A 1/1985 Avery ..... 220/71
4,725,804 A * 2/1988 Yarpezeshkan ..... 336/5

FOREIGN PATENT DOCUMENTS

JP 61-219122 9/1986
JP 8-203759 8/1996
JP 9-180946 7/1997

* cited by examiner

*Primary Examiner*—Lincoln Donovan
*Assistant Examiner*—Tuyen T. Nguyen
(74) *Attorney, Agent, or Firm*—Mattingly, Stanger & Malur, P.C.

(57) ABSTRACT

Leakage fluxes from windings and leads of a stationary induction apparatus are confined within a tank. The stationary induction apparatus includes an electric functional units each including a winding and a core, a tank containing the electric functional units, high-voltage leads leading out from the windings, and low-voltage leads leading out from the windings. Magnetic shields are placed on the inner surface of a wall of the tank through which the high-voltage leads are drawn out of the tank, and a composite shield formed by combining nonmagnetic shields and magnetic shields is placed on the inner surface of a wall of the tank facing the low-voltage leads and is electrically short-circuited.

5 Claims, 11 Drawing Sheets

STATIONARY INDUCTION APPARATUS

This is a divisional application of U.S. Ser. No. 09/649,595, filed Aug. 29, 2000 now U.S. Pat. No. 6,469,607.

BACKGROUND OF THE INVENTION

1. Field of the Invention

The present invention relates to a stationary induction apparatus, such as a transformer or a reactor, provided with an improved magnetic shield on the inner surface of a tank.

2. Description of the Related Art

Generally, leakage flux from a winding included in a stationary induction apparatus, such as a transformer or a reactor, increases as the capacity of the stationary induction apparatus increases. If leakage flux penetrates a structure, such as a tank wall or a core clamping structure, loss increases, efficiency decrease or local overheating occurs.

A known method of suppressing loss and preventing local overheating installs a highly conductive, nonmagnetic shield, such as a copper or aluminum shield, on the inner surface of the tank wall and induces an eddy current that cancels out leakage flux that penetrates the tank wall in the nonmagnetic shield. Another method of preventing the increase of loss and local overheating places a magnetic shield, i.e., a silicon steel plate having a high magnetic permeability, on the inner surface of the tank wall to absorb leakage flux and to prevent the penetration of leakage flux through the tank wall. The method using the magnetic shield is applied prevalently to large-capacity stationary induction apparatuses.

The stationary induction apparatus has a winding, high-voltage leads leading out from the winding and connected to external bushings, and low-voltage leads leading out from the winding and connected to external bushings. The high-voltage leads are extended through through holes formed in a tank wall into a leader pocket. Since the through holes are formed in the tank wall facing the winding, the magnetic shield disposed in a region including the through holes must be divided into upper and lower parts along a line corresponding to the through holes.

Consequently, the magnetic resistance of a portion of the wall not covered with the magnetic shield increases and leakage flux from the winding penetrates the portion of the tank wall around the through holes. Thus, loss increases, local overheating occurs and satisfactory shielding effect cannot be achieved. The low-voltage leads placed on a side opposite a side on which the high-voltage leads are placed are extended along the inner surface of the tank wall at a position dislocated laterally from a position opposite the winding. However, leakage fluxes created by a high current that flows through the low-voltage leads penetrate the wall through gaps between the plurality of magnetic shields to cause increase in loss and local overheating.

A structure disclosed in Japanese Patent Laid-open No. Sho 61-219122 is capable of reducing loss that may be produced in the tank wall by the leakage fluxes from the windings and the leads and preventing local overheating. This prior art structure has elongate magnetic shields formed by laminating thin magnetic plates and arranged in an upright position in a lateral arrangement on the inner surface of a tank wall facing windings, and electromagnetic shields of highly conducting plates attached to a tank wall facing leads through which a high current flows. Leakage flux from the winding is absorbed by the magnetic shields, and leakage flux from the leads is repulsed by the reactive effect of eddy currents induced in the electromagnetic shield by magnetic fields created by the current flowing through the leads to prevent the penetration of the leakage flux through the tank wall.

The structure disclosed in Japanese Patent Laid-open No. Sho 61-219122 has the elongate magnetic shields arranged on the inner surface of the tank wall facing the windings, and the highly-conducting electromagnetic shields attached to the tank wall facing leads, absorbs the leakage flux from the winding by the magnetic shields, and prevents the penetration of the leakage fluxes from the leads through the tank wall facing the leads by the reactive effect of eddy currents induced in the electromagnetic shields to reduce loss that may be produced in the wall of the tank.

This prior art structure is intended for application to single-phase transformers and its effect is not necessarily satisfactory with three-phase transformers. In a three-phase transformer having three windings linearly arranged in a tank and leads leading out from the windings, particularly, the low-voltage leads, disposed between the windings, it is possible that both the leakage fluxes from the windings and the leakage fluxes from the leads penetrate the tank wall. Nothing about such a problem is taken into consideration by Japanese Patent Laid-open No. Sho 61-219122 and the prior art structure is unable to reduce loss that may be produced in the walls of the leader pockets into which the leads are extended and the tank cover.

This prior art still has problems to be solved concerning the reduction of loss and the prevention of local overheating in portions of the tank facing the high-voltage leads and the low-voltage leads.

SUMMARY OF THE INVENTION

The present invention has been made in view of the foregoing problems and it is therefore an object of the present invention to provide a highly reliable stationary induction apparatus capable of preventing the penetration of leakage flux from windings and leads through tank walls and of preventing the increase of loss and local overheating.

With the foregoing object in view, the present invention provides a means for creating magnetic flux of a polarity opposite that of leakage flux from windings and low-voltage leads by an eddy current induced by the leakage flux on the inner surface of a tank wall having portions facing the low-voltage leads or provides a means for creating magnetic flux of a polarity opposite that of leakage flux from windings and low-voltage leads by an eddy current induced by the leakage flux on the inner surface of a tank wall having portions facing the low-voltage leads and a means for absorbing the leakage flux from the windings on a tank wall facing the low-voltage leads, in which the means for creating the magnetic flux of a polarity opposite that of the leakage flux from the leads is disposed on the tank wall having at least a portion facing the low-voltage leads.

More concretely, a composite shield formed by combining a nonmagnetic shield and a magnetic shield is disposed on the inner surface of a tank wall facing the low-voltage leads, the nonmagnetic shield of the composite shield has a portion facing the low-voltage leads, and a portion of the nonmagnetic shield lies between the windings.

With such a construction, the leakage flux from the windings and the low-voltage leads is unable to penetrate the tank wall, so that loss can be reduced and local overheating can be prevented.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
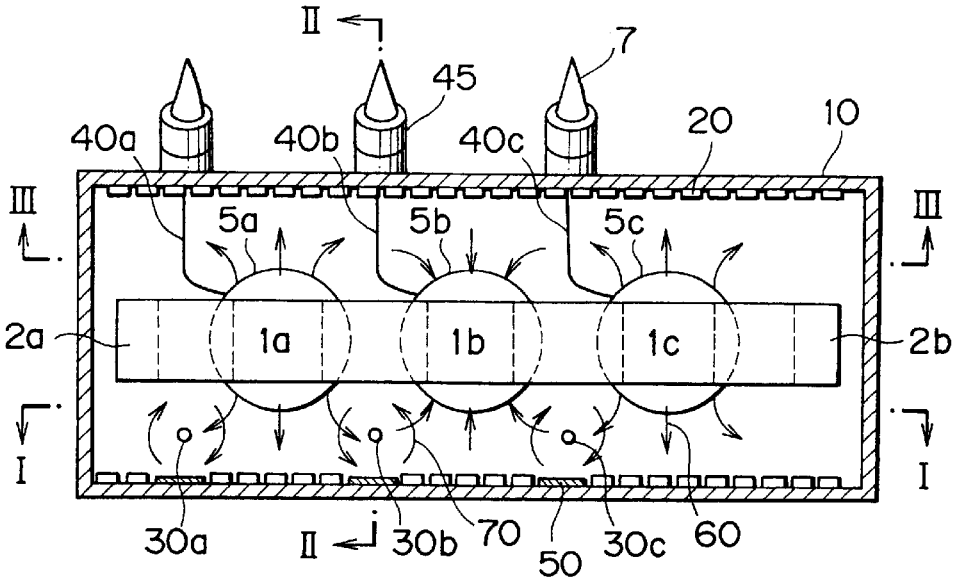
FIG. 1 is a plan view of a three-phase five-leg transformer, i.e., a stationary induction apparatus, in a first embodiment according to the present invention.

Referring to FIGS. 1 to 4, a three-phase five-leg transformer in a first embodiment according to the present invention has main legs 1*a,* 1*b* and 1*c,* a U-phase winding 5*a* wound on the main leg 1*a,* a V-phase winding 5*b* wound on the main leg 1*b,* and a W-phase winding 5*c* wound on the main leg 1*c*. The windings 5*a,* 5*b,* and 5*c,* the main legs 1*a,* 1*b* and 1*c,* side legs 2*a* and 2*b,* an upper yoke 3 and a lower yoke 4 constitute a transformer unit. The transformer unit is contained in a tank 10 together with an insulating medium, such as oil or gas.

Low-voltage leads 30*a,* 30*b* and 30*c* respectively leading out from the windings 5*a,* 5*b* and 5*c* are extended vertically along the inner surface of a wall of the tank 10 at positions not corresponding to the windings 5*a,* 5*b* and 5*c*. The low-voltage leads 30*a,* 30*b* and 30*c* are extended through a leader pocket 35 and are connected to bushings 6. High-voltage leads 40*a,* 40*b* and 40*c* leading out from the windings 5*a,* 5*b* and 5*c* are extended through through holes 15 formed in a middle portion, with respect to height, of a wall of the tank at positions not corresponding to the windings 5*a,* 5*b* and 5*c* into leader pockets 45 and connected to bushings 7.

Figure 2:
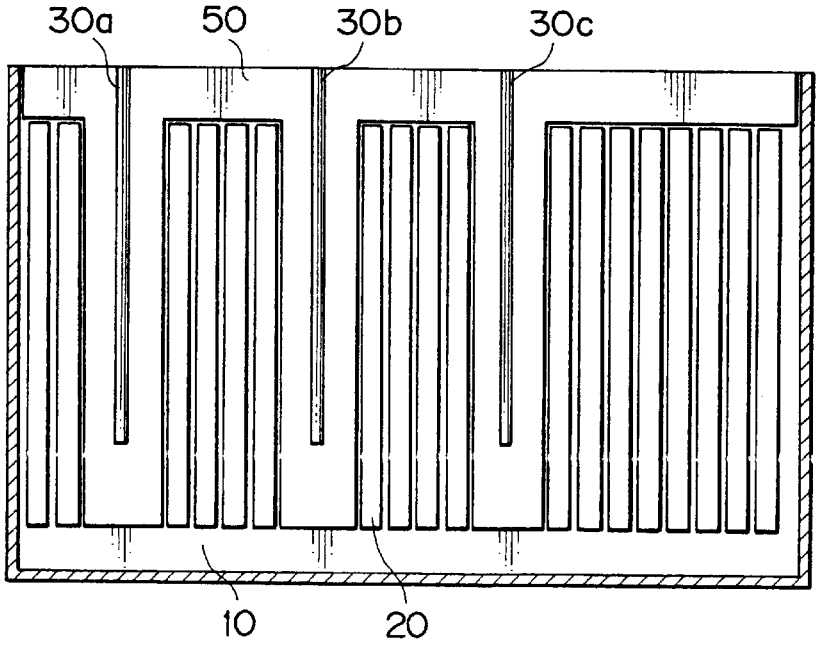
FIG. 2 is a sectional view taken on line I—I in FIG. 1.
Figure 3:
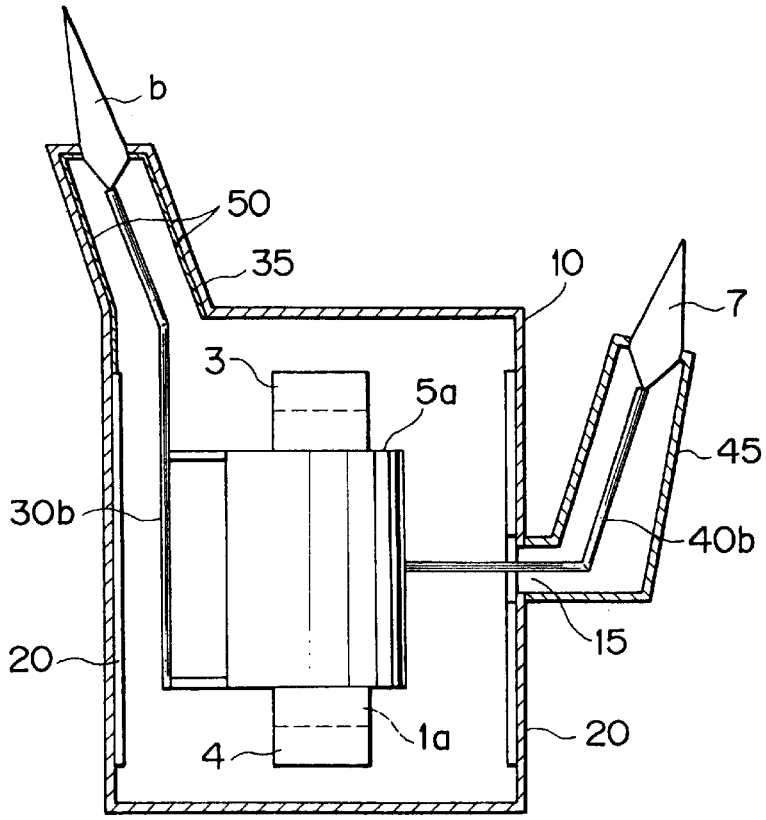
FIG. 3 is a sectional view taken on line II—II in FIG. 1.
Figure 4:
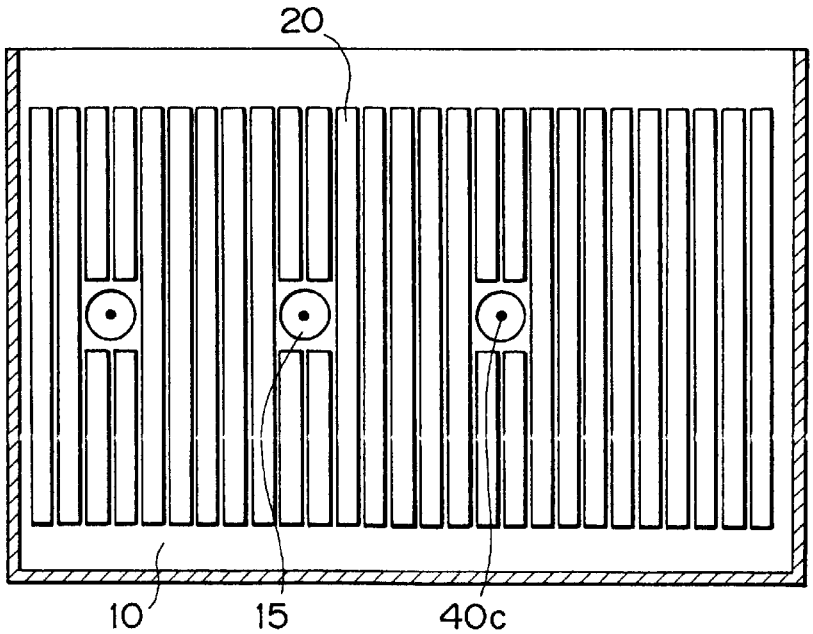
FIG. 4 is a sectional view taken on line III—III in FIG. 1.

As shown in FIG. 4, elongate magnetic shields 20 formed by laminating thin silicon steel plates are attached to the inner surface of the wall of the tank 10 on the side of the high-voltage leads 40*a,* 40*b* and 40*c* so as to cover the inner surface excluding regions around the through holes 15. As shown in FIGS. 1 to 3, a composite shield formed by combining magnetic shields 20 formed by laminating thin silicon steel plates, and a nonmagnetic shields 50 of copper or aluminum is attached longitudinally to the inner surface of the wall of the tank 10 on the side of the low-voltage leads 30*a,* 30*b* and 30*c*. Portions of the nonmagnetic shields 50 extend between the windings 5*a* and 5*b* and between the windings 5*b* and 5*c*. As shown in FIGS. 2 and 3, portions of the nonmagnetic shields 50 are extended in the leader pocket 35 for the low-voltage leads 30*a,* 30*b* and 30*c* and are electrically short-circuited in the leader pocket 35.

Even though leakage fluxes 60 from the windings 5*a,* 5*b* and 5*c* and leakage fluxes 70 from the low-voltage leads 30*a,* 30*b* and 30*c* try to extend through the walls of the tank 10 as indicated by the arrows, the leakage fluxes 60 from the windings 5*a,* 5*b* and 5*c* are absorbed by the magnetic shields 20 and are unable to penetrate the wall of the tank 10. The leakage fluxes 70 from the low-voltage leads 30*a,* 30*b* and 30*c* and leakage fluxes from the windings 5*a,* 5*b* and 5*c* extending toward the side of the low-voltage leads 30*a,* 30*b* and 30*c* are repulsed by magnetic fluxes of reverse polarity, not shown, created by eddy currents induced in the nonmagnetic shields 50 by magnetic fields created by currents that flows through the low-voltage leads 30*a,* 30*b* and 30*c* and are unable to penetrate the wall of the tank 10.

Figure 5:
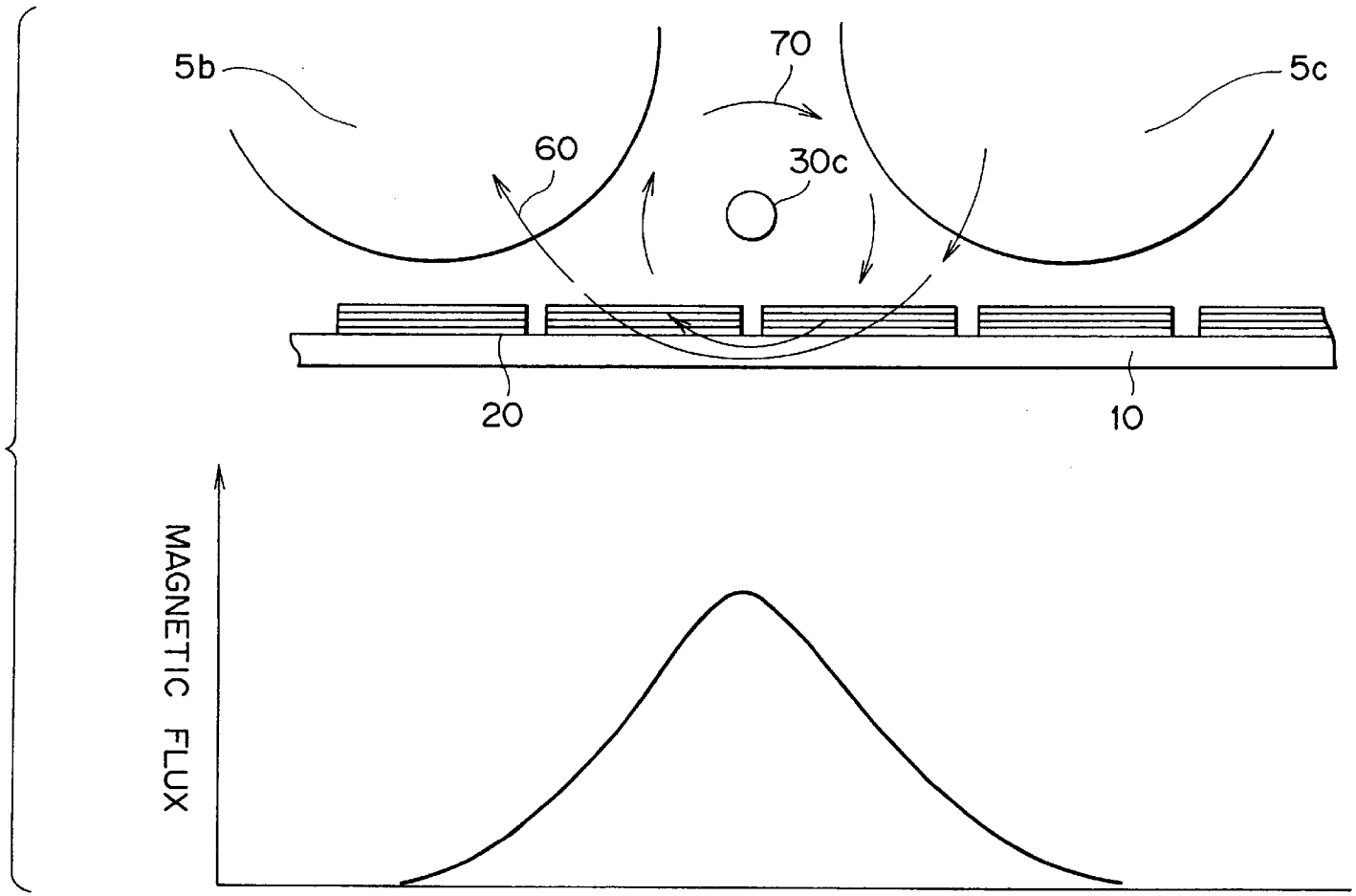
FIG. 5 is a diagrammatic view showing a magnetic flux distribution around a low-voltage lead in a conventional transformer.
Figure 6:
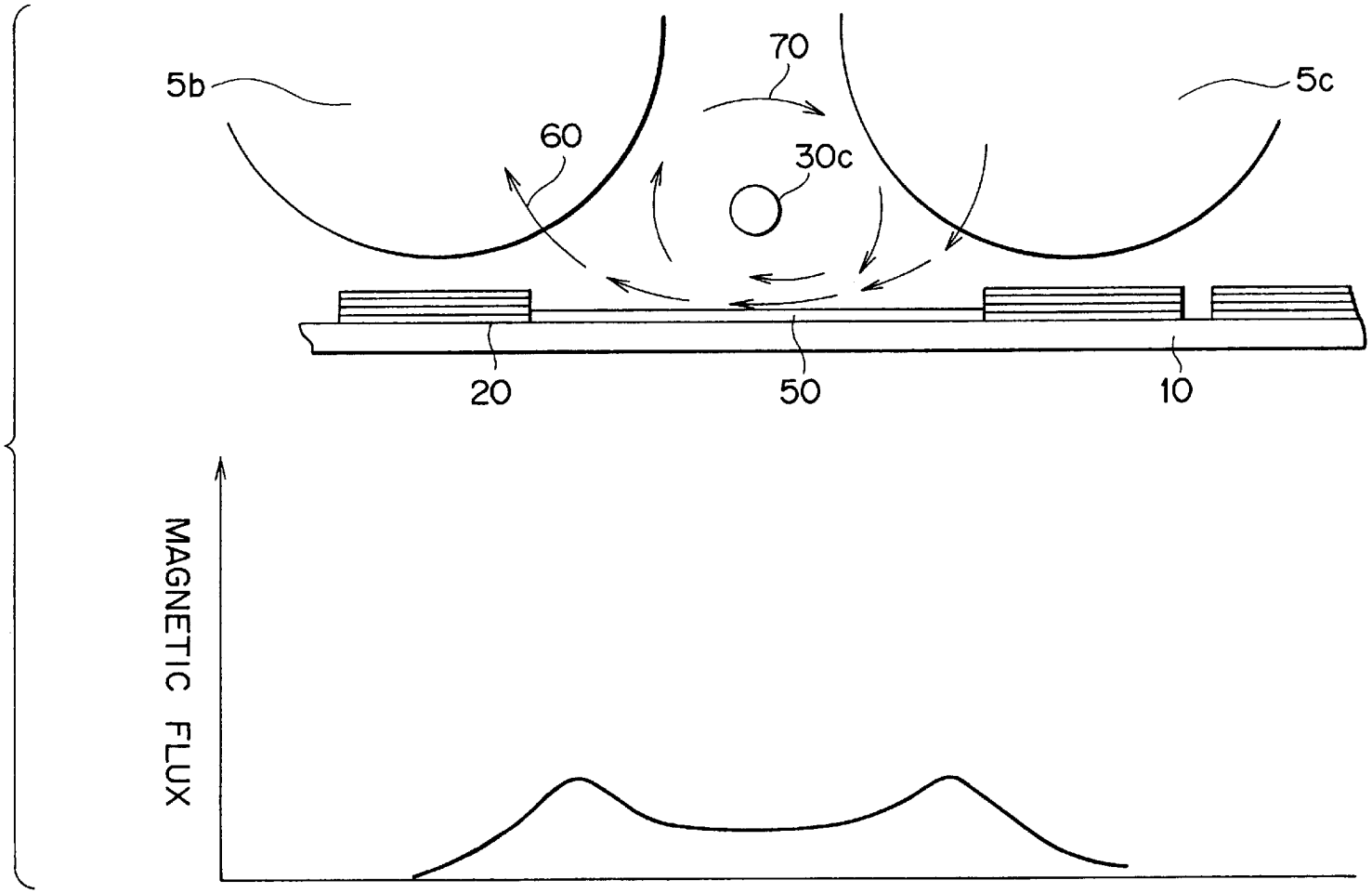
FIG. 6 is a diagrammatic view showing a magnetic flux distribution around a low-voltage lead in the transformer shown in FIG. 1.

Modes of distribution of the leakage magnetic fluxes in the transformer in the first embodiment and a conventional transformer will be comparatively described. FIG. 5 shows a magnetic flux distribution around a low-voltage lead in a conventional transformer and FIG. 6 shows a magnetic flux distribution around a low-voltage lead in the transformer shown in FIG. 1. Each of FIGS. 5 and 6 shows a portion of the transformer around a low-voltage lead 30*c* disposed between windings 5*b* and 5*c* and a magnetic flux distribution with respect to the length of a tank 10.

Referring to FIG. 5, in a conventional transformer, the leakage fluxes 60 and 70 from the winding 5*c* and the low-voltage lead 30*c* tend to extend through the wall of the tank 10. Most part of the leakage fluxes 60 and 70 is absorbed by magnetic shields 20 formed by laminating silicon steel plates and arranged at predetermined intervals on the inner surface of the wall 10. Since the leakage flux 70 is represented by coaxial cylinders having center axes coinciding with the low-voltage lead 30*c,* the leakage flux 70 penetrates portions of the wall 10 corresponding to gaps between the magnetic shields 20 because the portions corresponding to the gaps provide magnetic resistance. Since the leakage flux 60 from the winding 5*c* is superposed on the leakage flux 70, a large amount of leakage flux penetrates the wall 10 of the tank. Therefore, the magnetic flux distribution has a peak at a position corresponding to a region around a gap between the magnetic shields 20 corresponding to the low-voltage lead 30*c*.

In the transformer in the first embodiment shown in FIG. 6, the nonmagnetic shields 50 are attached to the inner surface of the wall of the tank 10 on the side of the low-voltage lead 30*c*. Therefore, the leakage fluxes 60 and 70 from the winding 5*c* and the low-voltage lead 30*c* are repulsed by magnetic fluxes of a polarity opposite those of the leakage fluxes 60 and 70, created by eddy currents induced in the nonmagnetic shields 50 and are unable to penetrate the wall of the tank 10. Consequently, the magnetic flux distribution has low magnetic flux densities at positions corresponding to a region around the low-voltage lead 30*c*.

The leakage fluxes 70 from the low-voltage leads 30*a*, 30*b* and 30*c* tend to extend through walls defining the leader pocket 35. Since the nonmagnetic shields 50 are attached on the inner surfaces of the leader pocket 35, the leakage fluxes 70 are repulsed by magnetic fluxes, not shown, of a polarity opposite those of the leakage fluxes 70, created by eddy currents induced in the nonmagnetic shields 50 and are unable to penetrate the walls of the leader pocket 35. Consequently, increase in loss that may be produced in the walls of the tank 10 and the leader pocket 35 for the low-voltage leads 30*a*, 30*b* and 30*c* and local temperature rise can be prevented, so that the performance and the durability of the transformer can be greatly improved. Since area on the inner surfaces of the walls of the tank 10 covered by the nonmagnetic shields 50 is narrower than that covered by the magnetic shields 20, increase in loss can be limited to the least extent.

The leakage fluxes 60 from the windings 5*a*, 5*b* and 5*c* tend to penetrate the wall of the tank 10 provided with the through holes 15 through which the high-voltage leads 40*a*, 40*b* and 40*c* are drawn outside. Since the magnetic shields 20 are attached to the inner surface of the wall of the tank 10 provided with the through holes 15, the leakage fluxes 60 from the windings 5*a*, 5*b* and 5*c* are absorbed effectively by the magnetic shields 20. Consequently, the increase of loss that may be produced in the walls of the tank 10 and local temperature rise can be prevented, so that the transformer is highly reliable.

Figure 7:
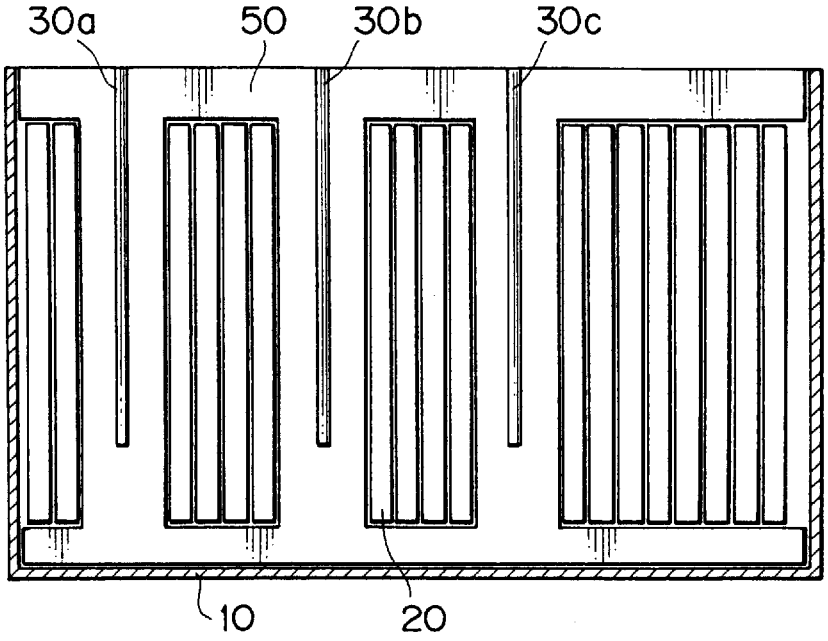
FIG. 7 is a view, similar to FIG. 2, showing a modification of the wall of the tank on the side of the low-voltage leads.

FIG. 7 is a view, similar to FIG. 2, showing a wall in a modification of the wall of the tank 10 on the side of the low-voltage leads. As shown in FIG. 7, nonmagnetic shields 50 are arranged on the inner surface of a wall of the tank 10 along which the low-voltage leads 30*a*, 30*b* and 30*c* leading out from the windings are raised so as to enclose magnetic shields 20 partly for electric short-circuiting.

When the magnetic shields 20 and the nonmagnetic shields 50 are thus arranged on the wall, even thought the leakage fluxes 60 from the windings 5*a*, 5*b* and 5*c* tend to extend to the surfaces of the magnetic shields 20 as indicated by the arrows, tend to extend vertically in the magnetic shields 20 and tend to extend into the wall of the tank 10 from the lower ends of the magnetic shields 20, the leakage fluxes 60 are repulsed by magnetic flux of a polarity opposite that of the leakage fluxes 60, created by eddy currents, not shown, induced in the nonmagnetic shields 50 and, consequently, the leakage fluxes 60 are unable to penetrate the wall of the tank 10. Therefore, loss that may be produced in the wall of the tank 10 can be greatly reduced, local temperature rise can be prevented and the transformer is highly reliable.

Figure 8:
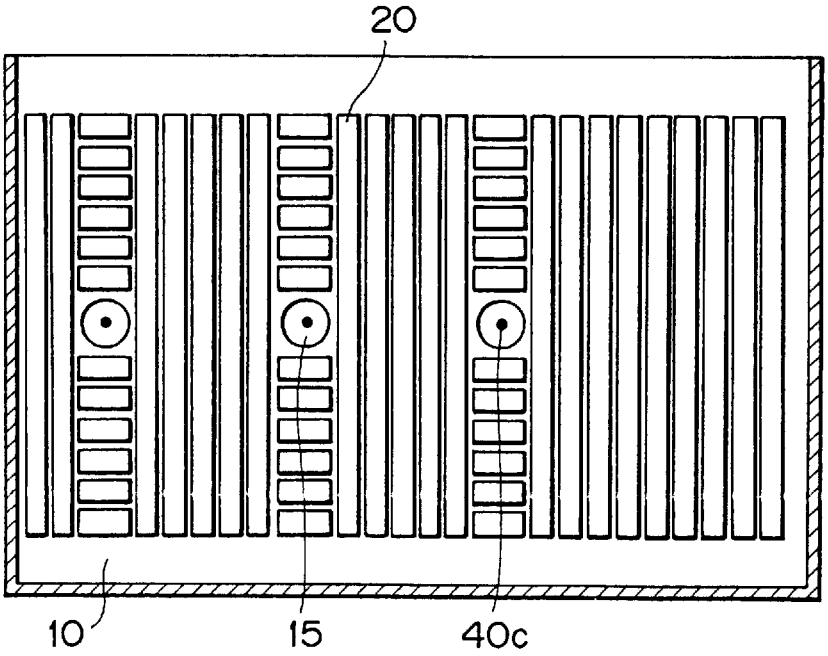
FIG. 8 is a view, similar to FIG. 4, showing a modification of the wall of the tank on the side of the high-voltage leads.

FIG. 8 is a view, similar to FIG. 4, showing a wall in a modification of the wall of the tank 10 on the side of the high-voltage leads. As shown in FIG. 8, the high-voltage leads 40*a*, 40*b* and 40*c* are extended through through holes 15 formed in a wall of the tank 10 on the side of the high-voltage leads 40*a*, 40*b* and 40*c* into the leader pockets 45. Magnetic shields 20 are arranged in an upright position on the inner surface of the wall excluding regions extending over and under the through holes 15, and magnetic shields 20 are arranged in a lateral position in the region extending over and under the through holes 15.

Although the leakage fluxes 60 from the windings 5*a*, 5*b* and 5*c* indicated by the arrows in FIG. 1 tend to extend along the length of the tank in spaces between the windings 5*a*, 5*b* and 5*c* to extend trough the wall of the tank 10, most part of the leakage fluxes from the windings 5*a*, 5*b* and 5*c* is absorbed effectively by the magnetic shields 20 because the inner surface of the wall including the regions above and under the through holes 15 is covered with the magnetic shields 20. Consequently, loss that may be produced in the wall of the tank 10 can be greatly reduced, local temperature rise can be prevented and the transformer is highly reliable.

Figure 9:
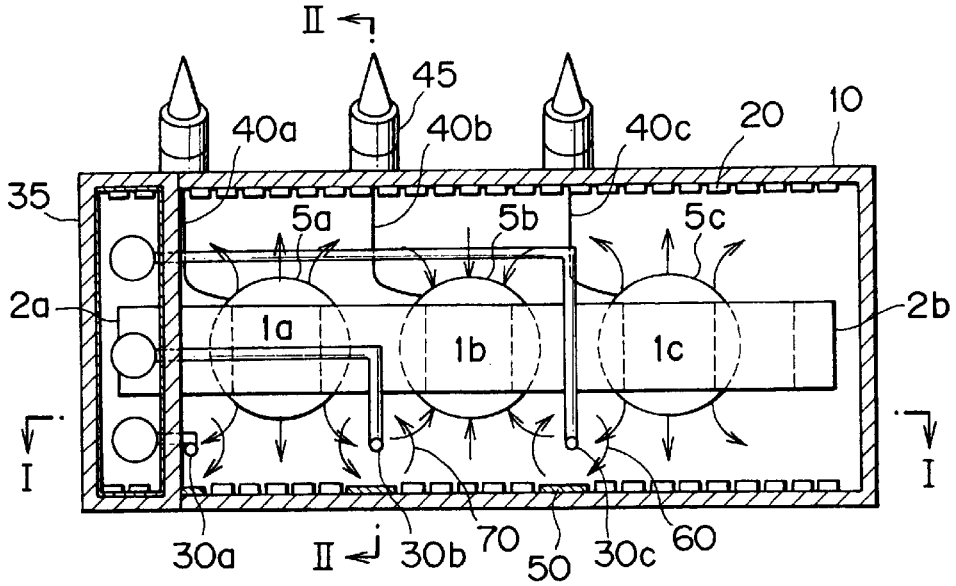
FIG. 9 is a plan view of a three-phase five-leg transformer, i.e., a stationary induction apparatus, in a second embodiment according to the present invention.
Figure 10:
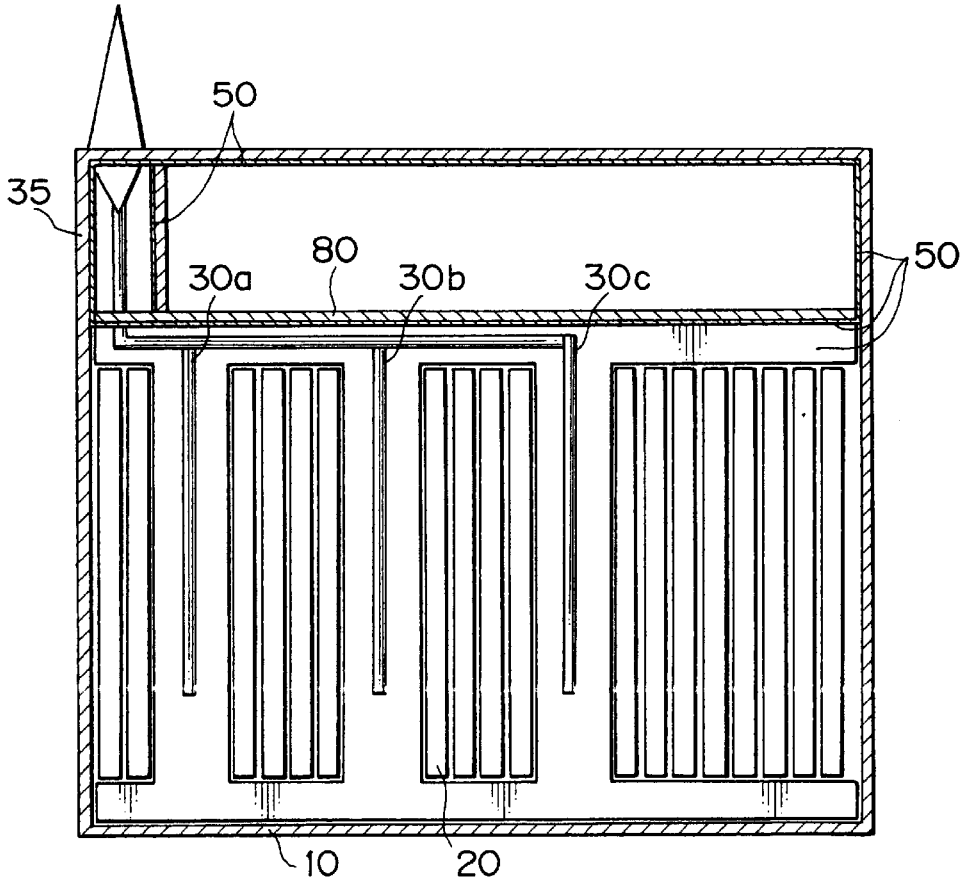
FIG. 10 is a sectional view taken on line I—I in FIG. 9.
Figure 11:
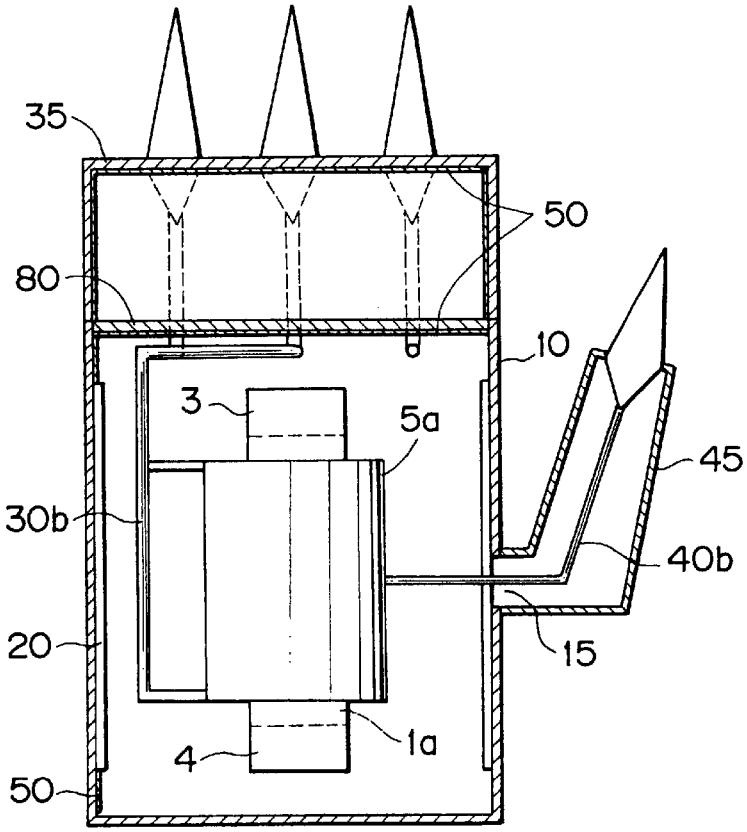
FIG. 11 is a sectional view taken on line II—II in FIG. 9.

A three-phase five-leg transformer in a second embodiment according to the present invention will be described with reference to FIGS. 9, 10 and 11, in which parts like or corresponding to those shown in FIGS. 1, 2 and 3 are denoted by the same reference characters and the description thereof will be omitted. Referring to FIGS. 9, 10 and 11, low-voltage leads 30*a*, 30*b* and 30*c* respectively leading out from windings 5*a*, 5*b* and 5*c* are extended vertically along the inner surface of a wall of the tank 10. The low-voltage leads 30*a*, 30*b* and 30*c* are extended through a space between a transformer unit and a tank cover 80 into a leader pocket 35. Nonmagnetic shields 50 are extended over the inner surface of a wall of the tank 10 facing the low-voltage leads 30*a*, 30*b* and 30*c* and over the inner surface of the tank cover 80 and the inner surfaces of the leader pocket 35, and are electrically short-circuited at a position where the low-voltage leads are connected to bushings.

Although leakage fluxes 70 from the low-voltage leads 30*a*, 30*b* and 30*c* tend to penetrate the wall of the tank 10, magnetic fluxes, not shown, of a polarity opposite that of the leakage fluxes 70, created by eddy currents, not shown, induced in the nonmagnetic shields 50 repulse the leakage fluxes 70 to obstruct the penetration of the leakage fluxes 70 through the wall of the tank 10. Although the leakage fluxes 70 from the low-voltage leads 30*a*, 30*b* and 30*c* tend to extend through the tank cover 80, magnetic fluxes, not shown, of a polarity opposite that of the leakage fluxes 70, created by eddy currents, not shown, induced in the nonmagnetic shields 50 covering the inner surface of the tank cover 80 repulse the leakage fluxes 70 to obstruct the penetration of the leakage fluxes 70 through the tank cover 80. Consequently, loss that may be produced in the walls of the tank 10, leader pockets 35 for the low-voltage leads 30*a*, 30*b* and 30*c* and the tank cover 80 can be reduced, local temperature rise can be prevented, and the performance and durability of the transformer can be greatly improved.

Although the tank 10 in the second embodiment is provided with the single leader pocket 35 to receive all the low-voltage leads 30*a*, 30*b* and 30*c*, the tank 10 may be provided with separate leader pockets 35 respectively for the low-voltage leaders 30*a*, 30*b* and 30*c*.

Figure 12:
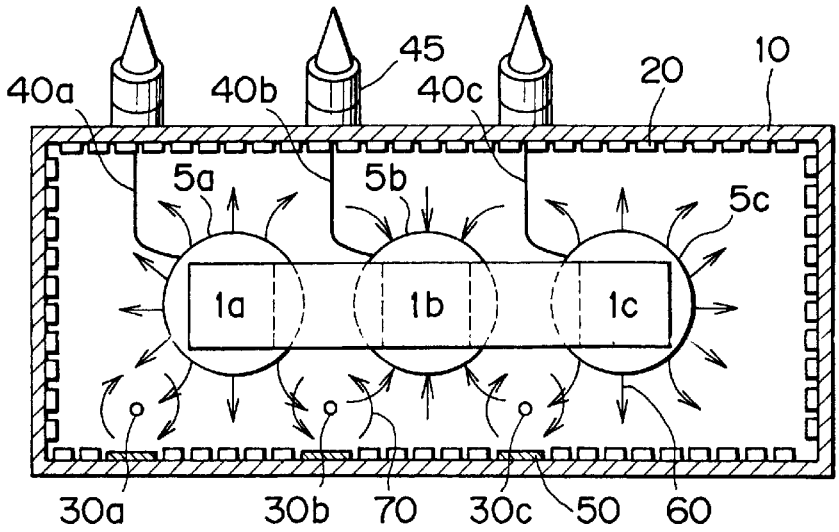
FIG. 12 is a plan view of a three-phase three-leg transformer, i.e., a stationary induction apparatus, in a third embodiment according to the present invention.

A three-phase three-leg transformer in a third embodiment according to the present invention will be described with reference to FIG. 12, in which parts like or corresponding to those shown in FIG. 1 are denoted by the same reference characters and the description thereof will be omitted. Referring to FIG. 12, magnetic shields 20 are arranged on the inner surfaces of walls of a tank 10. A composite shield formed by combining magnetic shields 20 and nonmagnetic shields 50 is placed on the inner surface of a wall of the tank 10 along which low-voltage leads 30*a*, 30*b* and 30*c* are extended vertically. The nonmagnetic shields 50 are extended into a leader pocket 35 for the low-voltage leads 30*a*, 30*b* and 30*c* and are electrically short-circuited in the leader pocket 35.

Since the surfaces not facing the low-voltage leads 30*a*, 30*b* and 30*c* also are covered with the magnetic shields 20, leakage fluxes 60 from windings 5*a,* 5*b* and 5*c* can be effectively absorbed and hence loss that may be produced in the walls of the tank 10 can be greatly reduced. Although the leakage fluxes 70 from the low-voltage leads 30*a,* 30*b* and 30*c* tend to extend through the wall of the tank 10 as indicated by the arrows, magnetic fluxes, not shown, of a polarity opposite that of the leakage fluxes 70, created by eddy currents induced in the nonmagnetic shields 50 placed on the inner surface of the wall of the tank 10 repulse the leakage fluxes 70 to obstruct the penetration of the leakage fluxes 60 and 70 through the wall. Consequently, loss that may be produced in the walls of the tank 10 and the leader pocket 35 for the low-voltage leads 30*a,* 30*b* and 30*c* can be reduced, local temperature rise can be prevented and the performance and durability of the transformer can be greatly improved.

Since the inner surfaces of the walls of the tank 10 not facing high-voltage leads 40*a,* 40*b* and 40*c* and the low-voltage leads 30*a,* 30*b* and 30*c* are covered with the magnetic shields 20, the tank 10 can be formed in a small size. Since part of the leakage fluxes 70 from the low-voltage leads 30*a,* 30*b* and 30*c* is absorbed by the magnetic shields 20, the nonmagnetic shields 50 may be thin.

Figure 13:
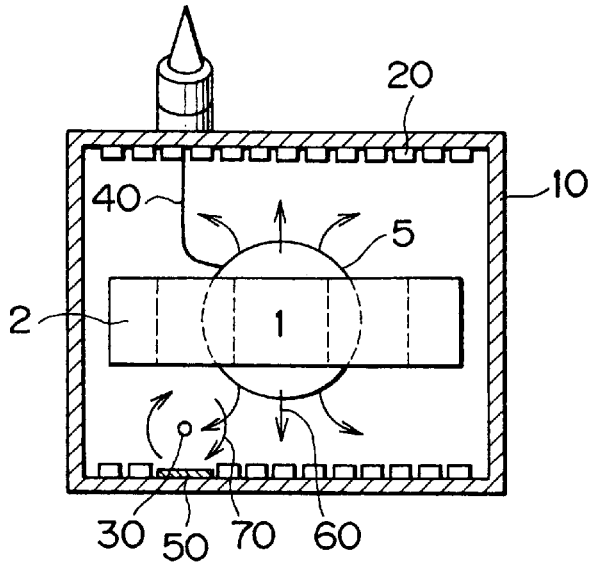
FIG. 13 is a plan view of a single-phase center-core transformer, i.e., a stationary induction apparatus, in a fourth embodiment according to the present invention.

A single-phase center-core transformer in a fourth embodiment according to the present invention will be described with reference to FIG. 13, in which parts like or corresponding to those shown in FIG. 12 are denoted by the same reference characters and the description thereof will be omitted. As shown in FIG. 13, the single-phase center-core transformer has a leg 1, a winding 5 wound on the leg 1, and a leg 2 on which any winding is not formed. Magnetic shields 20 are placed on the inner surfaces of walls of a tank 10 facing the winding 5, and a composite shields formed by combining magnetic shields 20 and nonmagnetic shields 50 is placed on the inner surface of a wall of the tank 10 along which a low-voltage lead 30 is extended vertically. the nonmagnetic shields 50 are extended into a leader pocket 35 for the low-voltage lead 30 and are electrically short-circuited in the leader pocket 35.

Part of leakage flux 70 from the low-voltage leads 30 and leakage flux 60 from the winding 5 tends to extend through the walls of the tank 10, magnetic flux, not shown, of a reverse polarity created by eddy currents, not shown, induced in the nonmagnetic shields 50 placed on the inner surface of the wall of the tank 10 repulses the leakage fluxes 60 and 70 to obstruct the penetration of the leakage fluxes 60 and 70 through the wall. Consequently, loss that may be produced in the walls of the leader pocket 35 for the low-voltage lead 30 can be greatly reduced, local temperature rise can be prevented and the transformer is highly reliable.

Figure 14:
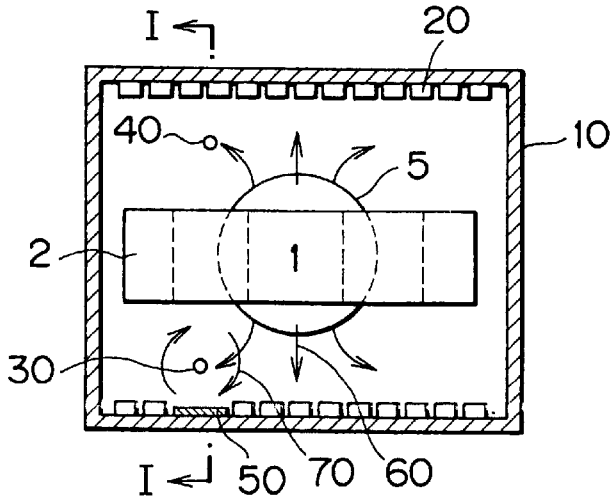
FIG. 14 is a plan view of a single-phase center-core transformer, i.e., a stationary induction apparatus, in a fifth embodiment according to the present invention.
Figure 15:
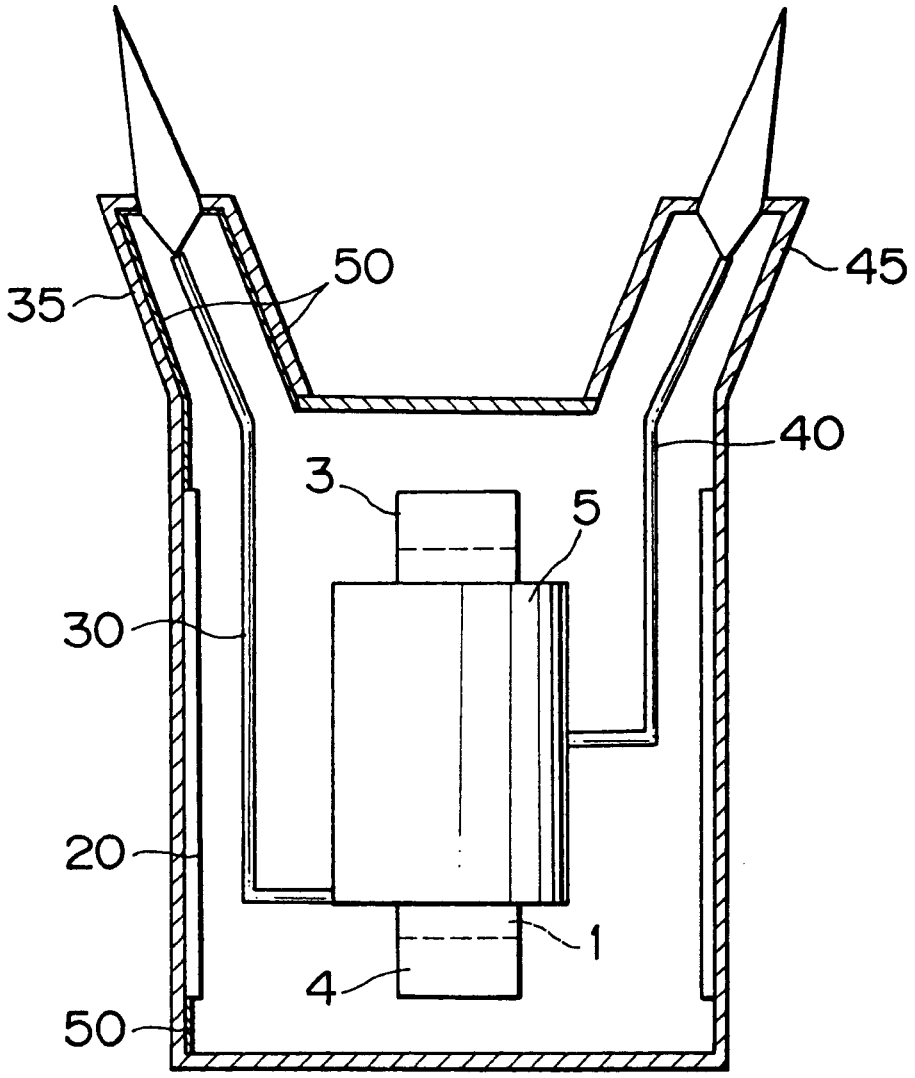
FIG. 15 is a sectional view taken on line I—I in FIG. 14.

Referring to FIGS. 14 and 15 showing a single-phase center-core transformer in a fifth embodiment according to the present invention, a leader pocket 45 for a high-voltage lead 40 is formed on a tank cover 80. A nonmagnetic shield 50 placed on the inner surface of a wall of a tank 10 facing a low-voltage lead 30 is extended into a leader pocket 35 for the low-voltage lead 30 and is electrically short-circuited.

Although leakage flux 70 from the low-voltage lead 30 tends to extend through the wall of the tank 10, magnetic flux, not shown, of a reverse polarity created by eddy currents, not shown, induced in the nonmagnetic shield 50 placed on the inner surface of the wall of the tank 10 repulses the leakage flux 70 to obstruct the penetration of the leakage flux 70 through the wall. Consequently, loss that may be produced in the walls of the tank 10 and the leader pocket 35 can be greatly reduced, local temperature rise can be prevented and the transformer is highly reliable. Since the leader pocket 45 for the high-voltage lead 40 is formed on the tank cover 80, the transformer can be formed in a small size, which facilitates the transportation of the transformer.

Naturally, the structural conception of the fifth embodiment is applicable to a single-phase two-leg transformer and a single-phase four-leg transformer for the same effect.

Figure 16:
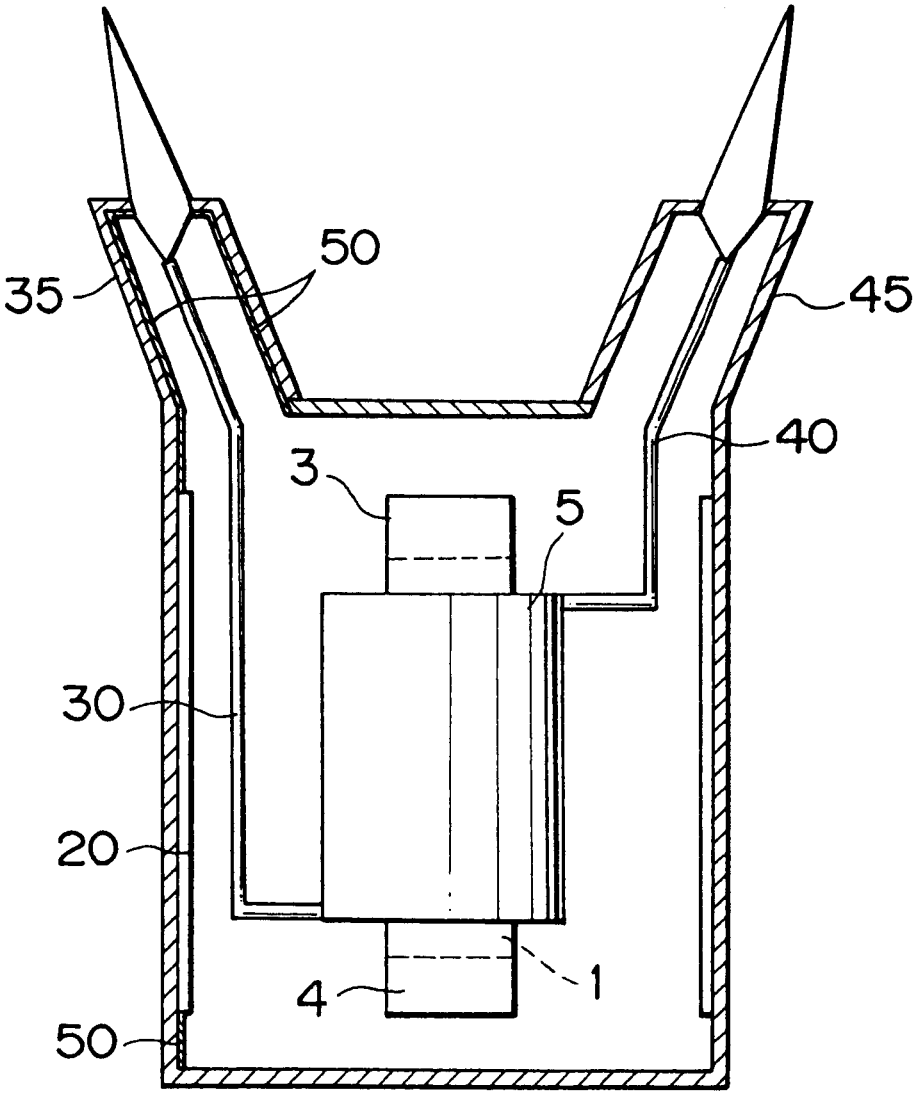
FIG. 16 is a view, similar to FIG. 15, of a single-phase center-core transformer, i.e., a stationary induction apparatus, in a sixth embodiment according to the present invention.

A single-phase center-core transformer in a sixth embodiment according to the present invention will be described with reference to FIG. 16, in which parts like or corresponding to those shown in FIG. 15 are denoted by the same reference characters and the description thereof will be omitted. As shown in FIG. 16, a high-voltage lead 40 leading out from a winding 5 is extended from an upper part of the winding 5 into a leader pocket 45. Since the high-voltage lead 40 extends from the upper part of the winding 5, regions on a tank 10 and a magnetic shields 20 in which an electric field is concentrated are reduced and the transformer is highly reliable. Since the high-voltage lead 40 is relatively short, work necessary for connecting the high-voltage lead 40 to a bushing can be reduced.

Figure 17:
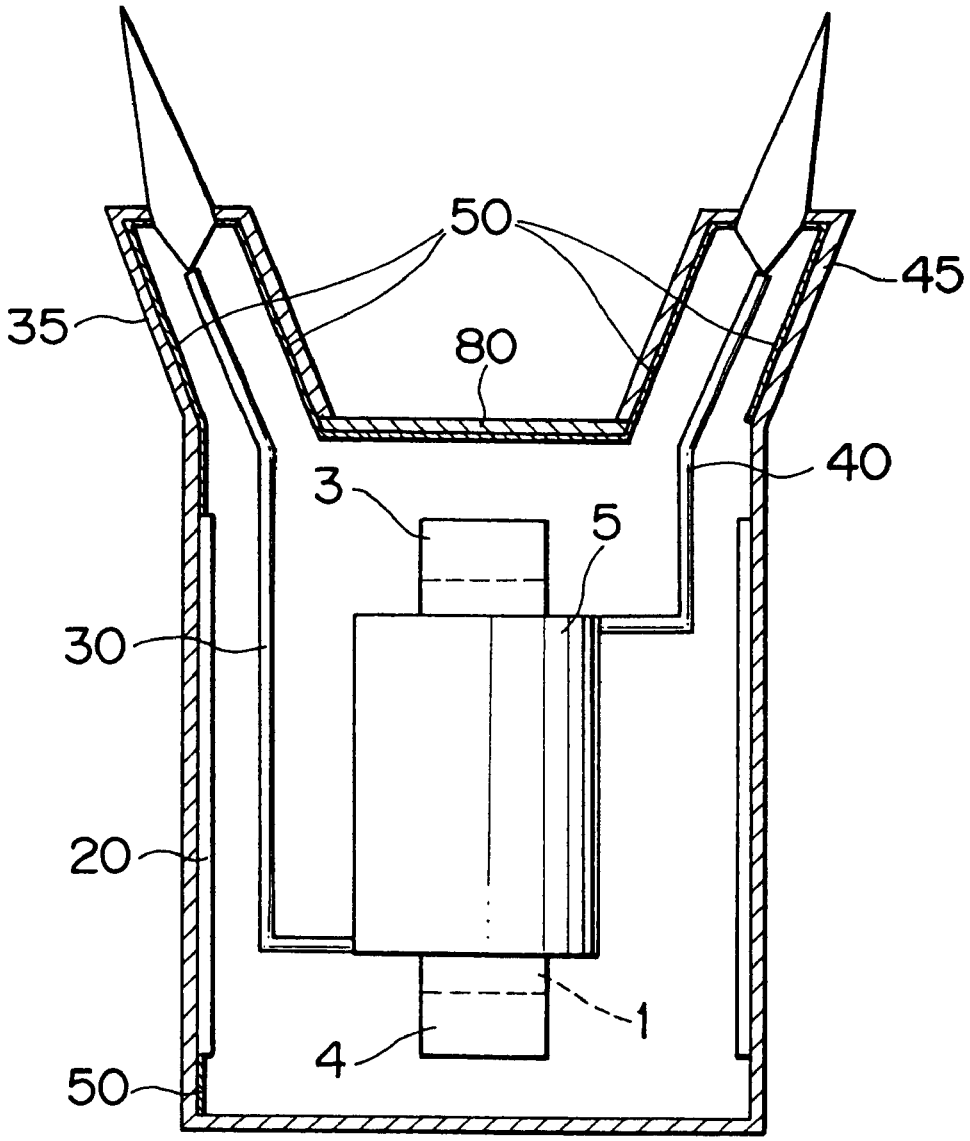
FIG. 17 is a view, similar to FIG. 15, of a single-phase center-core transformer, i.e., a stationary induction apparatus, in a seventh embodiment according to the present invention.

A single-phase center-core transformer in a seventh embodiment according to the present invention will be described with reference to FIG. 17, in which parts like or corresponding to those shown in FIG. 16 are denoted by the same reference characters and the description thereof will be omitted. As shown in FIG. 17, a low-voltage lead 30 extends from a winding 5, and a nonmagnetic shield 50 placed on the inner surface of a wall of a tank 10 facing the low-voltage lead 30 is extended through a leader pocket 35 for the low-voltage lead 30, a tank cover 80 into a leader pocket 45 for a high-voltage lead 40 and is electrically short-circuited.

Although leakage flux, not shown, from the low-voltage lead 30 tend to extend through the wall of the tank 10, magnetic flux, not shown, of the reverse polarity created by eddy currents, not shown, induced in the nonmagnetic shield 50 attached to the inner surface of the wall of the tank 10 obstructs the penetration of the leakage flux through the wall. Although the leakage flux, not shown, from the low-voltage lead 30 tends to extend through the tank cover 80, magnetic flux, not shown, of the reverse polarity created by eddy currents, not shown, induced in the nonmagnetic shield 50 covering the inner surface of the tank cover 80 repulses the leakage flux from the low-voltage lead 30 to prevent the penetration of the leakage flux through the tank cover 80. Consequently, losses that may be produced in the walls of the tank 10, the leader pocket 35 for the low-voltage lead 30, the tank cover 80 and the walls of the leader pocket 45 for the high-voltage lead 40 can be greatly reduced, local temperature rise can be prevented and hence the transformer is highly reliable.

Although the present invention has been described as applied to the transformers, the present invention is applicable also to reactors for the same effects. The effect of the present invention with a tank having an oval shape in a plan view is the same as that with the tank having a rectangular shape in a plan view.

As apparent from the foregoing description, the stationary induction apparatus according to the present invention is capable of obstructing the exvoltage of the leakage flux through the walls of the tank, of reducing loss produced in the walls of the tank and of preventing local temperature rise, and is highly reliable.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A stationary induction apparatus comprising, as principal components:

an electric functional unit including a winding and a core;

a tank containing the electric functional unit;

a high-voltage lead leading out from the winding and extended through a through hole formed in a wall of the tank facing the high-voltage lead at a position laterally dislocated from a position directly opposite the winding; and a low-voltage lead leading out from the winding on a side opposite a side on which the high-voltage lead is extended, and extended vertically along a wall of the tank facing the low-voltage lead;

wherein a composite shield formed by combining nonmagnetic shields and magnetic shields is placed on an inner surface of the wall of the tank facing the low-voltage lead, the nonmagnetic shields of the composite shield are placed in positions including a region facing the low-voltage lead and are extended to a leader pocket through which the low-voltage lead is drawn out of the tank and is electrically short-circuited in the leader pocket.

2. A stationary induction apparatus comprising, as principal components:

electric functional units for three phases each including a winding and a core;

a tank containing the electric functional units;

high-voltage leads leading out respectively from the windings and extended through through holes formed in a wall of the tank facing the high-voltage leads at positions laterally dislocated from positions directly opposite the windings; and low-voltage leads leading out respectively from the windings on a side opposite a side on which the high-voltage leads are extended, and extended vertically along a wall of the tank facing the low-voltage leads;

wherein a composite shield formed by combining nonmagnetic shields and magnetic shields is placed on an inner surface of the wall of the tank facing the low-voltage leads, and the nonmagnetic shields of the composite shield are placed in positions including a region facing the low-voltage leads, are extended into a leader pocket through which the low-voltage leads are drawn out of the tank and are electrically short-circuited in the leader pocket.

3. A stationary induction apparatus comprising, as principal components:

an electric functional unit including a winding and a core;

a tank containing the electric functional unit;

a high-voltage lead leading out from the winding and extended through a through hole formed in a wall of the tank facing the high-voltage lead at a position laterally dislocated from a position directly opposite the winding; and a low-voltage lead leading out from the winding on a side opposite a side on which the high-voltage lead is extended, extended vertically along a wall of the tank facing the low-voltage lead and through a space between the electric functional unit and a tank cover and drawn out of the tank;

wherein a composite shield formed by combining nonmagnetic shields and magnetic shields is placed on an inner surface of the wall of the tank facing the low-voltage leads, and the nonmagnetic shields of the composite shield are placed in positions including a region facing the low-voltage lead and are extended into the tank cover.

4. A stationary induction apparatus comprising, as principal components:

an electric functional unit including a winding and a core;

a tank containing the electric functional unit;

a high-voltage lead leading out from the winding and extended through a through hole formed in a wall of the tank facing the high-voltage lead at a position laterally dislocated from a position directly opposite the winding; and a low-voltage lead leading out from the winding on a side opposite a side on which the high-voltage lead is extended, extended vertically along a wall of the tank facing the low-voltage lead and through a space between the electric functional unit and a tank cover into a leader pocket;

wherein a composite shield formed by combining nonmagnetic shields and magnetic shields is placed on an inner surface of the wall of the tank facing the low-voltage leads, and the nonmagnetic shields of the composite shield are placed in positions including a region facing the low-voltage lead and are extended into the leader pocket.

5. A stationary induction apparatus comprising, as principal components:

an electric functional unit including a winding and a core;

a tank containing the electric functional unit;

a high-voltage lead leading out from the winding and extended through a through hole formed in a wall of the tank facing the high-voltage lead at a position laterally dislocated from a position directly opposite the winding; and a low-voltage lead leading out from the winding on a side opposite a side on which the high-voltage lead is extended, extended vertically along a wall of the tank facing the low-voltage lead and through a space the electric functional unit and a tank cover;

wherein a composite shield formed by combining nonmagnetic shields and magnetic shields is placed on an inner surface of the wall of the tank facing the low-voltage lead, and the nonmagnetic shields of the composite shield are placed in positions including a region facing the low-voltage lead and are extended from a leader pocket through which the low-voltage lead is drawn out of the tank through the tank cover into a leader pocket through which the high-voltage lead is drawn out of the tank.

* * * * *